US005261837A

United States Patent [19]

Kilsdonk et al.

[11] Patent Number: 5,261,837

[45] Date of Patent: Nov. 16, 1993

[54] HIGH DENSITY BI-PIN RECEPTACLE

[75] Inventors: Jan A. Kilsdonk, Corona; Merlen Teal, Tustin, both of Calif.

[73] Assignee: McDonnell Douglas Corporation, Long Beach, Calif.

[21] Appl. No.: 780,613

[22] Filed: Oct. 23, 1991

[51] Int. Cl.[5] ..... H01R 17/00

[52] U.S. Cl. ..... 439/617; 439/682

[58] Field of Search ..... 439/56, 611-619, 439/525, 682, 683

[56] References Cited

U.S. PATENT DOCUMENTS

| | | | |
|---|---|---|---|
| 2,069,238 | 2/1937 | Fraser | 362/226 |
| 2,953,769 | 9/1960 | Woofter et al. | 439/611 |
| 3,229,083 | 1/1966 | George, Jr. | 439/617 |
| 3,480,816 | 11/1969 | Fallon | 439/619 |
| 3,522,579 | 8/1970 | Matsuya | 439/619 |
| 3,859,554 | 1/1975 | Preziosi et al. | 439/619 |
| 4,403,276 | 9/1983 | Blaisdell | 362/226 |
| 4,471,414 | 9/1984 | Savage, Jr. | 362/226 |
| 4,608,624 | 8/1986 | Blaisdell et al. | 362/226 |
| 4,679,128 | 7/1987 | Van Duyn et al. | 362/306 |
| 4,713,019 | 12/1987 | Gaynor | 439/232 |
| 4,799,896 | 1/1989 | Gaynor et al. | 439/232 |
| 5,001,615 | 3/1991 | Stefanelli | 439/611 |

FOREIGN PATENT DOCUMENTS

| | | | |
|---|---|---|---|
| 2251509 | 5/1973 | Fed. Rep. of Germany | 439/242 |

*Primary Examiner*—David L. Pirlot

*Attorney, Agent, or Firm*—Donald E. Stout; John P. Scholl

[57] ABSTRACT

A simple and durable socket receptacle is adapted for receiving an electrical device such as a lamp which has a plurality of closely spaced contact pins. The receptacle comprises a dielectric means for receiving the contact pins which has a plurality of apertures which are in a one-to-one correspondence with the plurality of pins. When the device is inserted into the receptacle, each of the pins are received by a corresponding aperture. Above the dielectric pin receiving means is a space, into which extends at least one finger-like projection, upwardly from the pin receiving means. There is one projection for each two contact pins, and the projection is adapted to separate and insulate the plurality of contact pins from one another. A plurality of spring-like terminals also extend from the pin receiving means. The terminals are in one-to-one correspondence with the plurality of pins and are biased such that the corresponding pins and terminals are in contact with one another in the space above the receiving means and adjacent to the finger-like projection. A key feature is that the plurality of terminals are more widely spaced at the point at which they extend from the pin receiving means than are the apertures for receiving the corresponding pins. This greater spacing between the terminals allows greater insulation between them than is permitted in conventional sockets, thereby allowing the receptacle to meet government specifications with respect to dielectric withstanding voltage (DWV).

20 Claims, 2 Drawing Sheets

FIG. 6.
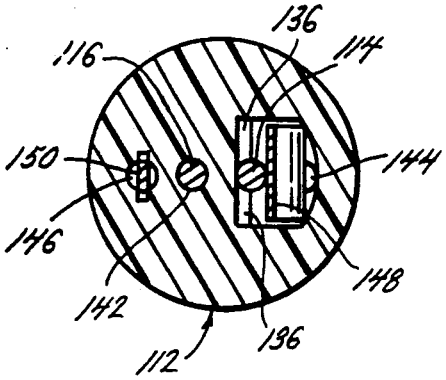
FIG. 7.
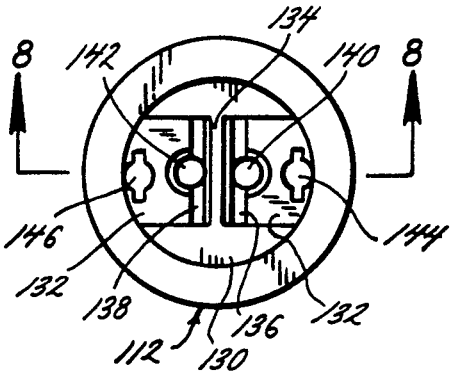
FIG. 9.
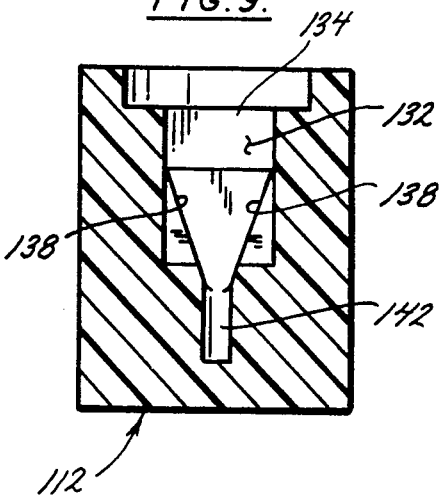
FIG. 8.
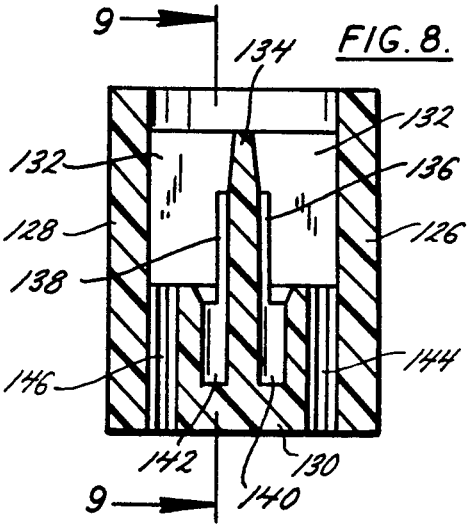
FIG. 11.
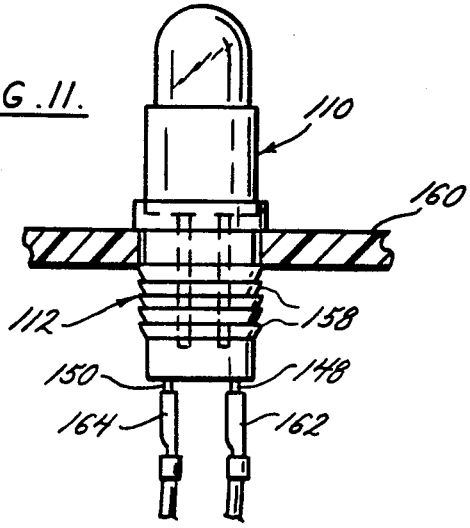
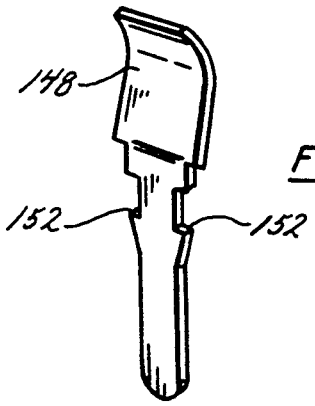
FIG. 10.

HIGH DENSITY BI-PIN RECEPTACLE

BACKGROUND OF THE INVENTION

This invention relates to electrical connectors, and more particularly to a high density bi-pin lamp socket for ensuring adequate dielectric withstanding voltage (DWV) between the terminals.

Presently, a great number of high density bi-pin lamps, wherein the contact pins are very close together, are employed in the manufacture of commercial aircraft. In a typical airliner, they are used to illuminate the No Smoking/Fasten Seat Belt signs, the floor proximity lighting fixtures, and other lighting applications. The problem is that Government specifications require such lamp sockets to withstand 1000 VRMS dielectric voltage between the socket terminals, tested with the lamp removed. Because the contacts are so closely spaced, this standard is extremely difficult to meet.

Referring now to the prior art figures (FIGS. 1 and 2), two alternate methods for installing the current state of the art lamps are shown. In FIG. 2, the lamp 10 is inserted into the receptacle 12 by inserting contact pins 14 and 16 into corresponding terminals 18 and 20 within the receptacle 12. The dielectric 22 separating and insulating the terminals 18 and 20 is theoretically adequate to provide the required dielectric withstanding voltage, but in actuality fails to do so in application. A prime reason for this failure is that the terminal sockets are soldered to a pair of printed circuit boards 23*a*, 23*b* (anode and cathode) through the dielectric 22 at joints 24, and these solder joints inevitably flow together, causing shorting across the spacing between the terminals. To combat this problem, the common currently employed installation method, as shown in FIG. 1, is to increase the spacing between the terminals 18 and 20 within the dielectric 12, such that there is a greater amount of dielectric insulation between them. To enable the more narrowly spaced lamp contact pins 14, 16 to be inserted into the more widely spaced terminal sockets, the pins are pulled and formed such that they transition from the narrow spacing at their proximal ends to a wider spacing equivalent to that of the terminals 18, 20 at their distal ends. However, this forming proces, typically performed by the lamp installers, is labor intensive and frequently causes cracking of the lamps procelain core, thereby shortening the life of the lamp.

What is needed, therefore, is an improved device which allows the contact terminals to be widely spaced as shown in FIG. 1 without requiring the contact pins of the lamp to be physically spread apart, thereby greatly decreasing the labor required to install the lamps while further increasing the longevity of the lamps as well.

SUMMARY OF THE INVENTION

This invention solves the problem outlined above by providing a simple and durable socket receptacle for receiving an electrical device such as the above-described lamp having a plurality of closely spaced contact pins. The receptacle comprises a dielectric means for receiving the contact pins which has a plurality of apertures which are in a one-to-one correspondence with the plurality of pins. When the device is inserted into the receptacle, each of the pins are received by a corresponding aperture. Above the dielectric pin receiving means is a space, into which extends at least one finger-like projection, upwardly from the pin receiving means. There is one projection for each two contact pins, and the projection is adapted to separate and insulate the plurality of contact pins from one another. A plurality of terminals also extends from the pin receiving means. The terminals are in one-to-one correspondence with the plurality of pins and are biased such that the corresponding pins and terminals are in contact with one another in the space above the receiving means and adjacent to the finger-like projection. A key feature is that the plurality of terminals are substantially more widely spaced at the point at which they extend from the pin receiving means than are the apertures for receiving the corresponding pins. This greater spacing between the terminals preferably at least about twice the spacing as that between the contact pins, allows the required DWV to be achieved.

The above mentioned and other objects and features of this invention and the manner of attaining them will become apparent, and the invention itself will be best understood, by reference to the following description taken in conjunction with the accompanying illustrative drawings.

BRIEF DESCRIPTION OF THE DRAWINGS

FIG. 6 is a cross-sectional view along the lines 6—6 of FIG. 4, showing further details of the inventive lamp socket;

FIG. 7 is a top plan view of the inventive lamp socket with the lamp removed, showing the inventive arrangement of terminal slots and pin guide apertures;

FIG. 8 is a cross-sectional view along the lines 8—8 of FIG. 7, showing further details of the inventive lamp socket with the lamp removed;

FIG. 9 is a cross-sectional view along the lines 9—9 of FIG. 8, showing details of the pin guide apertures;

FIG. 10 is an isolation view in perspective of one embodiment of the inventive terminals; and FIG. 11 is a cross-sectional view showing the inventive receptacle and lamp installed mounted for use in a typical application.

DETAILED DESCRIPTION OF THE DRAWINGS

Figure 3:
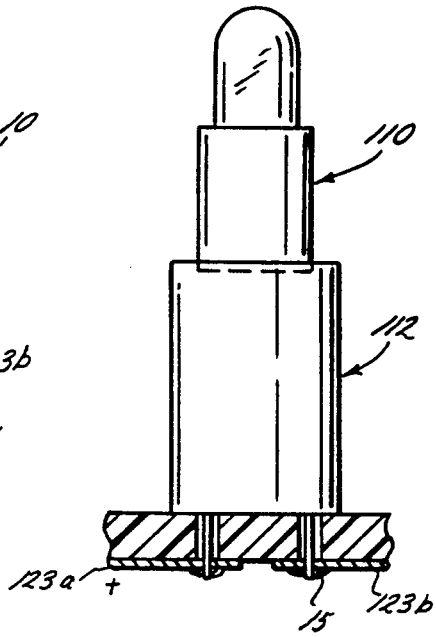
FIG. 3 is a cross-sectional view showing the installation of a high density bi-pin lamp into the dielectric lamp socket of the invention.
Figure 5:
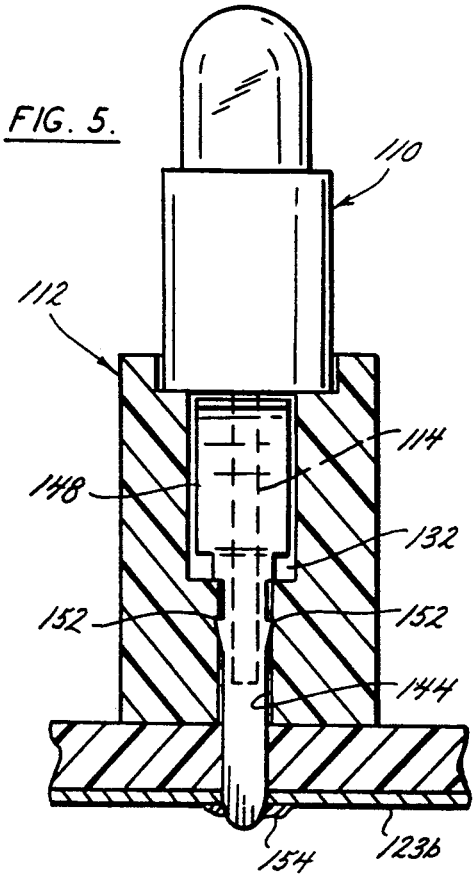
FIG. 5 is a cross-sectional view along the lines 5—5 of FIG. 4, showing further details of the inventive lamp socket.
Figure 4:
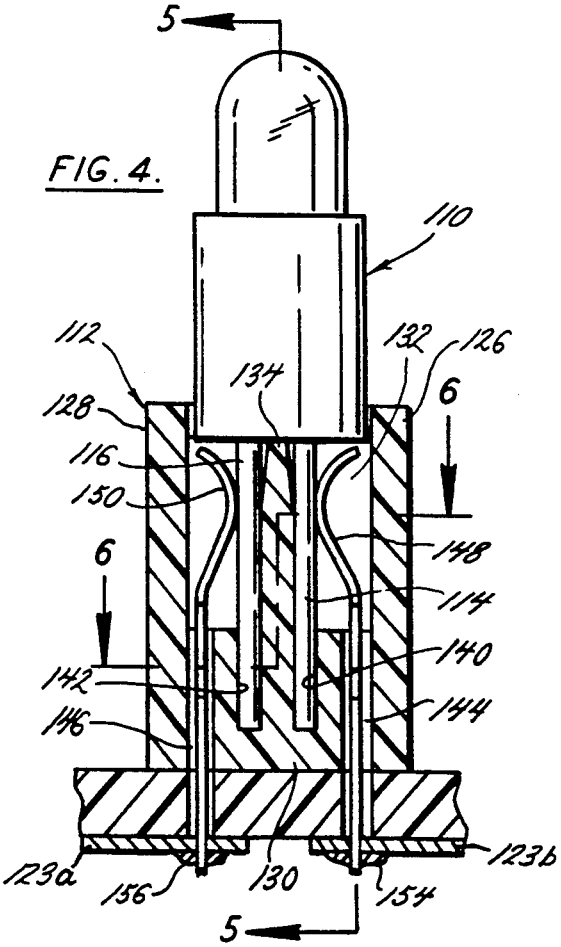
FIG. 4 is a cross-sectional view showing details of the inventive lamp socket with the lamp in the installed position.

Referring now to the drawings, FIGS. 3–5 show a bi-pin lamp 110 which has been inserted into the inventive lamp receptacle 112. The lamp 110 includes a pair of closely spaced contact pins 114, 116. Viewing FIGS. 6–10 in conjunction with FIGS. 3–5, and particularly FIG. 8, it can be seen that the receptacle 112 comprises outer wall member portions 126, 128, between which a cross-member 130 is transversely situated. Above the cross-member 130, and still within the confines of the outer wall member portions 126, 128 is a space 132. Extending upwardly from the cross-member 130 into the space 132 is a finger-like projection 134. Spanning the projection 134 on either side thereof are a pair of pin guide sleeves 136, 138. The pin guide sleeves may have a funnel shape (as shown in FIG. 9) to facilitate insertion of the lamp contact pins therein, and extend downwardly into the cross-member 130, terminating in a pair of pin guide apertures 140, 142. The pin guide apertures serve to receive the ends of the pins 114, 116 when the lamp is inserted into the receptacle 112.

Now viewing, in particular, FIGS. 4–8, terminal slots 144 and 146 are shown in the cross-member 130, positioned between the pin guide apertures 140, 142 and the outer wall portions 126, 128, such that the terminal slots 144, 146 are more widely spaced than the pin guide apertures 140, 142, for reasons to be more fully explained below. Extending upwardly from the terminal slots 144, 146 are a pair of terminals 148, 150. These terminals are pressed into the slots 144, 146 in the cross-member 130 and retained by a barb 152, as shown most clearly in FIG. 5. Each terminal 148, 150 may be comprised either of flat material stock, as shown in FIG. 10, or of round stock (not shown), and is configured so that its upper end portion is biased against its corresponding lamp pin contact 114, 116 by the terminal spring pressure. In the preferred embodiment, the terminals are fabricated of either leaded phosphor bronze or beryllium copper, though other materials may be used as well. In FIGS. 6 and 7, it can be seen that the terminal slots 144, 146 are keyhole shaped, in order to accommodate both flat and round stock type terminals.

In practice, the lamp is inserted by guiding the contact pins 114, 116 into the pin guide sleeves 136, 138, until the ends of the pins rest in the pin guide apertures 140, 142. The pins are guided into the pin guide sleeves by the terminals 148, 150, the spring pressure from the terminals forcing the pins into the guide sleeves (see FIG. 4). This process assures the lamp's position in the center line of the lamp receptacle 112. When the lamp is in its fully inserted position, the terminals 148, 150 firmly contact the corresponding pins 114, 116 at a point above the top of the pin guide sleeves 136, 138 to provide a solid electrical connection. The finger-like projection 134 serves as an insulation barrier separating the two contact pins 114, 116, and is of sufficient width to prevent shorting between the pins.

In a preferred embodiment, the projection 134 is about 0.022 inches wide to assure the necessary 1000 VRMS DWV between the pins 114, 116. The terminals 148, 150 transition from 0.042 inch pin centers to wider 0.100 inch centers at the slots 144, 146, or in other words, there should preferably be at least about twice the spacing between the terminals as that between the contact pins. Of course, other dimensions could be employed depending upon the desired application.

Figure 1:
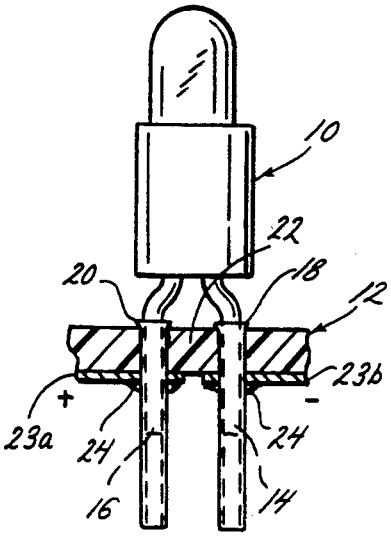
FIG. 1. (PRIOR ART)
FIG. 1 is a cross-sectional view showing the currently accepted method of installing a high density bi-pin lamp into a dielectric contact pin receiving means wherein the terminals are adequately spaced.
Figure 2:
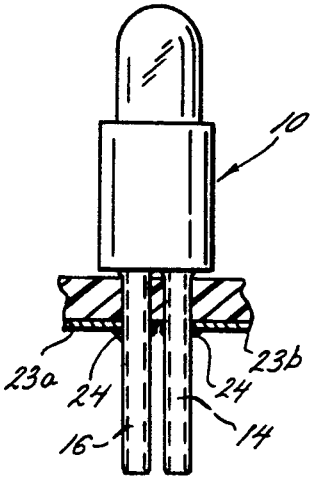
FIG. 2. (PRIOR ART)
FIG. 2 is a cross-sectional view similar to that of FIG. 1 showing the installation of a typical high density bi-pin lamp wherein the terminals for receiving the lamp contact pins are inadequately spaced.

The key advantage of this invention over the prior art, as exemplified in FIGS. 1 and 2, is the use of spring terminals 148, 150, which permits a stress-free transition from the more widely spaced terminal slots 144, 146 to the more closely spaced lamp contact pins 114, 116. Terminals 148, 150 are soldered to a pair of printed circuit boards 123*a*, 123*b* (anode and cathode) by means of joints 154, 156, in the same manner as terminals 18, 20 are in the FIG. 2 prior art embodiment, but because of the wider spacing between the terminals in the inventive embodiment shorting between the solder joints does not occur. To the contrary, shorting does occur in the FIG. 2 installation, preventing the installation from meeting DWV standards. Further, although the terminals 18, 20 in the FIG. 1 prior art embodiment are adequately spaced to prevent shorting and thus to permit an adequate dielectric withstanding voltage therebetween to meet government standards, the price to be paid is that the lamp contact pins are highly stressed, necessarily resulting in a very high replacement rate, as well as high labor and maintenance costs.

FIG. 11 shows a typical installation for the lamp receptacle assembly 112, wherein molded serrations 158 on the receptacle 112 permit retention of the receptacle 112 in a panel 160. The terminals 148, 150 are then connected to power supply wire assemblies 162, 164 by means of a conventional connector such as a spade fast-on or the like.

Although an exemplary embodiment of the invention has been shown and described, many changes, modifications, and substitutions may be made by one having ordinary skill in the art without departing from the spirit and scope of the invention. For example, the disclosed receptacle assembly may be used for many different applications outside of the aircraft field, including such diverse areas as space, ground vehicles, sea vessels, or any other application, stationary or otherwise, wherein it is necessary to maintain a safe DWV between terminals. Additionally, the invention may be applied to any type of electrical device having any number of contact pins, with the number of terminals corresponding to the number of pins on the device. Therefore, the scope of the invention is to be limited only in accordance with the following claims.

What is claimed is:

1. A receptacle for receiving an electrical device having a plurality of contact pins, comprising:

a dielectric means for receiving said contact pins, said pin receiving means having a plurality of apertures which are in a one-to-one correspondence with said plurality of pins for receiving said pins therein;

a space above said dielectric pin receiving means;

at least one finger-like projection extending from said receiving means upwardly into said space, said at least one projection being adapted to separate and insulate said plurality of contact pins from one another; and a plurality of terminals extending from said pin receiving means, said plurality of terminals being in a one-to-one correspondence with said plurality of pins and being biased such that said corresponding pins and terminals are in contact with one another in said space above said receiving means and adjacent to said finger-like projection;

wherein said plurality of terminals are substantially more widely spaced at the point at which they extend from said pin receiving means than are the apertures for receiving said corresponding pins, such that there is a substantial separation distance between each said pin and its corresponding terminal at said extension point.

2. The receptacle as recited in claim 1, wherein said plurality of terminals are formed of flat stock material.

3. The receptacle as recited in claim 1, wherein said plurality of terminals are formed of round stock material.

4. The receptacle as recited in claim 1, wherein said plurality of contact pins comprises two contact pins.

5. The receptacle as recited in claim 1, wherein said at least one finger-like projection includes a pin guide sleeve on either side thereof, said pin guide sleeves being adapted to guide said contact pins along said projection and into said apertures.

6. The receptacle as recited in claim 1, wherein said finger-like projection is approximately 0.022 inches wide.

7. The receptacle as recited in claim 1, wherein said pin receiving means includes a plurality of terminal slots therein, said terminal slots being positioned outwardly of said apertures with respect to the center of said dielectric means, such that said terminal slots are more widely spaced than said apertures, said terminals being pressed into said slots.

8. The receptacle as recited in claim 7, wherein said plurality of terminal slots are keyhole shaped in order to accommodate either flat or round stock type terminals.

9. The receptacle as recited in claim 7, wherein said plurality of terminal slots are at least about twice as widely spaced as are their said corresponding contact pins.

10. The receptacle as recited in claim 9, wherein said plurality of contact pins are on approximately 0.042 inch centers and said plurality of terminal slots are on approximately 0.100 inch centers.

11. A receptacle for receiving an electrical device having a pair of contact pins, said receptacle comprising:

an outer wall;

a dielectric cross-member transversely oriented between portions of said outer wall;

a pair of apertures in said dielectric cross-member, said apertures being spaced apart an equivalent distance to the spacing between said contact pins and being adapted to receive said pins therein;

a space above said dielectric cross-member and contained by said outer wall;

a finger-like projection extending from said cross-member upwardly into said space, said projection being adapted to separate and insulate said contact pins from one another; and a pair of terminals extending from said cross-member, said pair of terminals being biased such that corresponding terminals and contact pins are in electrical contact with one another in said space above said cross-member and adjacent to said finger-like projection;

wherein said terminals are substantially more widely spaced at the point at which they extend from said cross-member than are the apertures for receiving said contact pins.

12. The receptacle as recited in claim 11, wherein said plurality of terminals are formed of flat stock material.

13. The receptacle as recited in claim 11, wherein said plurality of terminals are formed of round stock material.

14. The receptacle as recited in claim 11, wherein said at least one finger-like projection includes a pin guide sleeve on either side thereof, said pin guide sleeves being adapted to guide said contact pins along said projection and into said apertures.

15. The receptacle as recited in claim 11, wherein said cross-member includes a plurality of terminal slots therein, said terminal slots being positioned outwardly of said apertures with respect to the center of said cross-member, such that said terminal slots are more widely spaced than said apertures, said terminals being pressed into said slots.

16. The receptacle as recited in claim 15, wherein said plurality of terminal slots are keyhole shaped in order to accommodate either flat or round stock type terminals.

17. The receptacle as recited in claim 11, said receptacle being equipped with means for being mounted on a panel for connection of said terminals to a power supply.

18. The receptacle as recited in claim 17, wherein said receptacle mounting means comprises a plurality of serrations on the external surface of said outer wall.

19. The receptacle as recited in claim 15, wherein said plurality of terminal slots are at least about twice as widely spaced as are their said corresponding contact pins.

20. The receptacle as recited in claim 19, wherein said plurality of contact pins are on approximately 0.042 inch centers and said plurality of terminal slots are on approximately 0.100 inch centers.

* * * * *